US006908332B2

(12) United States Patent
Takahashi et al.

(10) Patent No.: US 6,908,332 B2
(45) **Date of Patent: *Jun. 21, 2005**

(54) CONNECTOR

(75) Inventors: Hisafumi Takahashi, Tokyo (JP); Atsushi Makiuchi, Tokyo (JP)

(73) Assignee: Kel Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/763,956

(22) Filed: Jan. 22, 2004

(65) Prior Publication Data

US 2004/0224554 A1 Nov. 11, 2004

Related U.S. Application Data

(62) Division of application No. 09/924,190, filed on Aug. 6, 2001, now Pat. No. 6,685,499.

(51) Int. Cl.[7] ..... H01R 13/00
(52) U.S. Cl. ..... 439/483
(58) Field of Search ..... 439/483, 484

(56) References Cited

U.S. PATENT DOCUMENTS

| | | | | |
|---|---|---|---|---|
| 3,654,589 A | | 4/1972 | Di Stefano et al. | 439/483 |
| 4,210,377 A | | 7/1980 | La Voque | 439/484 |
| 4,307,924 A | | 12/1981 | Gibbs | 439/484 |
| 4,310,208 A | | 1/1982 | Webster et al. | 439/494 |
| 4,509,811 A | | 4/1985 | Amano et al. | 439/11 |
| 5,062,803 A | | 11/1991 | Howard et al. | 439/160 |
| 5,190,471 A | | 3/1993 | Barile et al. | 439/455 |
| 5,201,671 A | | 4/1993 | Elias | 439/483 |
| 5,516,305 A | | 5/1996 | Haluska | 439/484 |
| 5,567,181 A | * | 10/1996 | Lentz et al. | 439/694 |
| 5,679,014 A | * | 10/1997 | Lan-Jen | 439/160 |
| 6,089,924 A | * | 7/2000 | Wang | 439/694 |
| 6,095,849 A | | 8/2000 | Stekelenburg | 439/483 |
| 6,126,479 A | | 10/2000 | Lee | 439/484 |
| 6,319,049 B1 | | 11/2001 | Lee | 439/484 |
| 6,394,842 B1 | | 5/2002 | Sakurai et al. | 439/607 |
| 6,685,499 B2 | * | 2/2004 | Takahashi et al. | 439/483 |

FOREIGN PATENT DOCUMENTS

GB 002227132 A 7/1990

* cited by examiner

*Primary Examiner*—Thanh-Tam Le
(74) *Attorney, Agent, or Firm*—Robert J. Usher

(57) ABSTRACT

A connector structure 1 has a cable 3, and a left connector 10 and a right connector 20 connected respectively to left and right ends of the cable 3. The left and right connectors 10 and 20 respectively have terminal holding members 11, 21 that are made of an insulating material and hold a plurality of terminals, protective covers 13, 23 that are made of a conductive material and covers the terminal holding member, and pull tabs 15, 25. The pull tabs 15 and 25 respectively have tip end parts thereof bonded onto the covers 13, 23 respectively and extend out in the cable direction. The left and right connectors 10 and 20 are removed from respective counterpart connectors 5, 7 into which the left and right connector 10, 20 have been fitted by grasping the pull tabs 15, 25 and pulling in a direction such that the left and right connectors 10, 20 separate away from the respective counterpart connectors 5, 7.

10 Claims, 4 Drawing Sheets

1
3
5
7
10
11
13
15
20
20a
20b
21
23
25
A
B
D

CONNECTOR

This is a Division of application Ser. No. 09/924,190, filed Aug. 6, 2001, now U.S. Pat. No. 6,685,499.

FIELD OF THE INVENTION

The present invention relates to a connector, and more particularly to a connector having a terminal holding member that is made of an insulating material and holds terminals and a cable that is electrically connected to the terminals and extends out from the terminal holding member.

BACKGROUND OF THE INVENTION

To remove a connector, comprising a terminal holding member that is made of an insulating material and holds terminals and a cable that is electrically connected to the terminals and extends out from the terminal holding member, from a counterpart connector into which the connector has been fitted, the terminal holding member of the connector is grasped with one's hand and pulled.

However, in general, in the case that the cable electrically connected to the terminals is very thin (for example of diameter about 0.3 mm), the terminal holding member will also be small. To remove such a connector having a small terminal holding member from the counterpart connector, it is necessary to insert one's hand into a narrow space, grasp the terminal holding member and pull. There is thus a problem that the connector removing operation is difficult. Moreover, if, during the connector removing operation, one mistakenly grasps and pulls the cable connected to the terminals instead of the terminal holding member, a force is applied to the connecting parts between the terminals and the electrical wires, and thus a problem arises in that an electrical wire may be separated away from the connecting part thereof and disconnected.

SUMMARY OF THE INVENTION

An object of the present invention is to provide a connector for which the connector removing operation is easy and there is no risk of breaking the connections between the cable and the terminals during the connector removing operation.

A connector according to the present invention (for example, the left connector 10 or the right connector 20 in the embodiments) comprises terminals (for example, the terminals 17 or 27 in the embodiments), a terminal holding member that is made of an insulating material and holds the terminals, and a cable that is electrically connected to the terminals and extends out from the terminal holding member; the connector also has a pull tab that has a tip end part thereof bonded onto the terminal holding member and extends outwards, and the connector is removed from a counterpart connector into which the connector has been fitted by pulling the pull tab.

According to the connector having this constitution, a pull tab is bonded onto the terminal holding member, and hence the connector can easily be removed from the counterpart connector into which the connector has been fitted by grasping and pulling the pull tab. Moreover, there is no risk of mistakenly pulling the cable connected to the connector instead of the pull tab during the connector removing operation, and hence wire breakage is prevented.

Moreover, another connector according to the present invention comprises terminals, a terminal holding member that is made of an insulating material and holds the terminals, a cable that is electrically connected to the terminals and extends out from the terminal holding member, and a protective cover that is made of a conductive material and covers the terminal holding member; the connector also has a pull tab that has a tip end part thereof bonded onto the protective cover and extends outwards, and the connector is removed from a counterpart connector into which the connector has been fitted by pulling the pull tab.

According to the connector having this constitution, the connector can easily be removed from the counterpart connector into which the connector has been fitted by grasping and pulling the pull tab that has a tip end part thereof bonded onto the protective cover and extends outwards. Moreover, there is no risk of mistakenly grasping and pulling the cable instead of the pull tab during the connector removing operation, and hence wire breakage is prevented.

In the connectors having the above-mentioned constitutions, the pull tab may be formed from a conductive material. If the pull tab is formed from a conductive material and is bonded onto the terminal holding member made of an insulating material or the protective cover made of a conductive material, then the pull tab acts as a shield, and hence external magnetic fields can be prevented from entering into the connector, and thus the effects of noise or the like generated in the terminals can be suppressed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE PREFERRED EMBODIMENTS

Figures 1A, 1B, 1C, 1D:
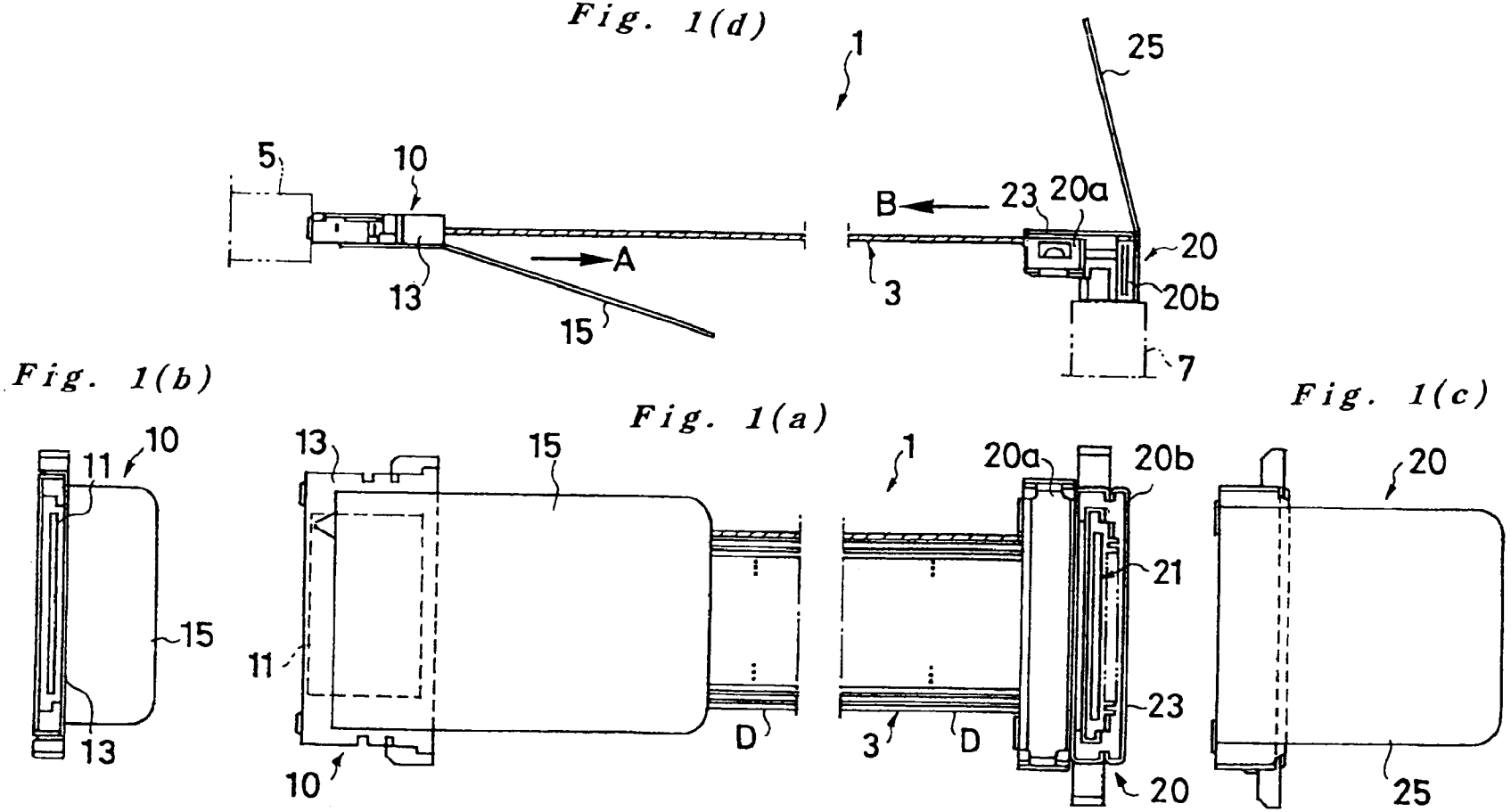
FIGS. 1(*a*) to 1(*d*) show left and right connectors according to an embodiment of the present invention, with FIG. 1(*a*) being a rear view of the two connectors, FIG. 1(*b*) being a left side view showing the left connector, FIG. 1(*c*) being a right side view showing the right connector, and FIG. 1(*d*) being a front view of the two connectors.

Following is a description of preferred embodiments of the present invention with reference to FIGS. 1 to 4. As shown in FIG. 1(*a*), a connector structure 1 comprises a cable 3 that extends in the left/right direction, and a straight type left connector 10 and a right-angled type right connector 20 connected respectively to left and right ends of the cable 3. The cable 3 is coated with a coating film made of an insulating material, and has provided therein a plurality of very thin electrical wires D (diameter about 0.3 mm) that are lined up in the up/down direction and each extend in the left/right direction.

Figure 2A:
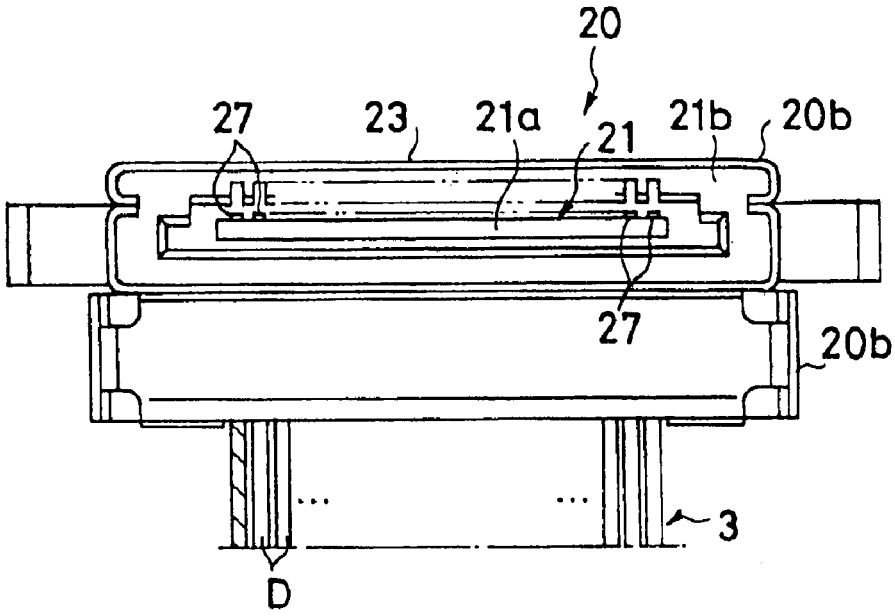
FIGS. 2(*a*) and 2(*b*) show the above-mentioned connectors, with FIG. 2(*a*) being a rear view of the right connector 20, and FIG. 2(*b*) being a left side view of the left connector 10.
Figure 2B:
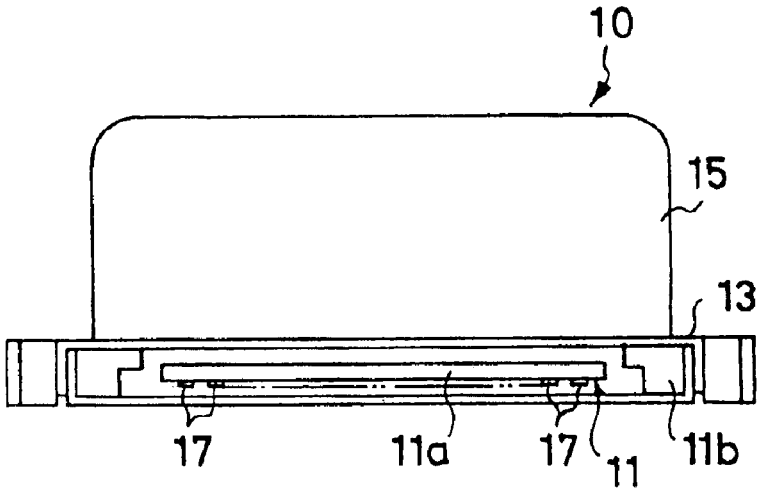

As shown in FIGS. 1(*a*), 1(*b*) and 1(*d*), the left connector 10 is formed in a box-like shape, and comprises a terminal holding member 11, a protective cover 13 and a pull tab 15. The terminal holding member 11 is made of an insulating material, and, as shown in FIG. 2(*b*), comprises a flat plate part 11*a*, and a pair of side plate parts 11*b*, which contact with and hold the flat plate part 11*a* on a base end side thereof, and, outside the flat plate part 11*a* in the width direction thereof each project out toward a tip end side with there being a prescribed space between the flat plate part 11*a* and the side plate part 11*b* in question. A plurality of terminals 17 are attached to a lower face of the flat plate part 11*a*, being lined up with a prescribed spacing therebetween in the width direction of the flat plate part 11*a*, and each extending in the front/back direction of the left connector 10. The protective cover 13 has a box-like shape and is attached to the outside of the terminal holding member 11 so as to surround the terminal holding member 11. The protective cover 13 is made of a conductive material, namely a metallic material such as SUS or Fe. The tip of the protective cover 13 is positioned so as to be approximately coplanar with the tip of the flat plate part 11*a* and the tips of the side plate parts 11*b*.

As shown in FIGS. 1(*a*) and 1(*d*), a pull tab 15 made of an insulating material is bonded onto a lower face of the protective cover 13. To remove the left connector 10 from a counterpart connector 5 into which the left connector 10 has been fitted as shown in FIG. 1, it would be possible to grasp each side of the protective cover 13 and pull, but the left connector 10 is small and hence it would be troublesome to try to insert one's hand into such a narrow space, and moreover there would be a risk of mistakenly pulling the cable 3. The pull tab 15 is thus provided on the left connector 10 to make the operation of removing the left connector 10 easier and to prevent the cable 3 from being pulled. Moreover, the right connector 20 is similar to the left connector 10 in this respect.

The pull tab 15 has a flat plate-like shape and is flexible. A tip end part of the pull tab 15 is bonded onto the lower face of the protective cover 13 using a strong adhesive. A rear end part of the pull tab 15 is bent downwards from a rear end face of the protective cover 13 and extends diagonally downwards. The pull tab 15 is formed from a material such as nylon, PET or a polyester.

As shown in FIG. 1, the right connector 20 has a box-like shape, comprises a main body part 20*a* that extends in a horizontal direction and a projecting part 20*b* that projects downwards from a right side lower part of the main body part 20*a*, and has a terminal holding member 21, a protective cover 23 and a pull tab 25. As shown in FIG. 2(*a*), the terminal holding member 21 comprises a flat plate part 21*a*, and a side plate part 21*b*, which contacts with and holds the flat plate part 211*a* on a base end side thereof, and curves toward the cable side, surrounding the flat plate part 21*a* with there being a prescribed space between the side plate part 21*b* and the outside of the flat plate part 21*a*. A plurality of terminals 27 are attached to a side face of the flat plate part 21*a* (the upper side face in FIG. 2(*a*)), being lined up with a prescribed spacing therebetween in the width direction of the flat plate part 21*a*. Each terminal 27 has a connecting part (not shown) that connects to an electrical wire D of the cable 3, with each electrical wire D being electrically connected by soldering.

The protective cover 23 is made of a conductive material and is attached to the outside of the terminal holding member 21. The protective cover 23 has a function of intercepting external magnetic fields, thus preventing magnetic fields from outside the connector acting on the terminals 27 provided in the connector and noise or the like being generated in the electrical signals that flow through the terminals 27. As shown in FIGS. 1(*c*) and 1(*d*), a pull tab 25 is bonded onto a tip end face of the protective cover 23. The pull tab 25 has a flat plate-like shape and is flexible. A rear end part of the pull tab 25 is bent toward the side of the cable 3 at a top face of the protective cover 23 and extends diagonally upwards. The pull tab 25 is made of the same material as the pull tab 15 bonded onto the left connector 10.

A description will now be given of the operation of the present invention when the left connector 10 and the right connector 20 are removed from the counterpart connectors into which the left connector 10 and the right connector 20 have been fitted. Firstly, a description will be given of the case of removing the left connector 10. Starting with a state in which the left connector 10 is fitted into the counterpart connector 5 as shown in FIG. 1(*d*), a worker first grasps the pull tab 15 of the left connector 10. While grasping the pull tab 15, the worker then pulls in a direction such that the left connector 10 separates away from the counterpart connector 5 (the direction of the arrow A in FIG. 1(*d*)). The left connector 10 thus moves through the action of the pull tab 15 in the direction of the arrow A away from the counterpart connector 5, and hence is removed.

A description will now be given of the case of removing the right connector 20. Starting with a state in which the right connector 20 is fitted into the counterpart connector 7 as shown in FIG. 1(*d*), a worker first grasps the pull tab 25 of the right connector 20. While grasping the pull tab 25, the worker then pulls in a direction such that the right connector 20 separates away from the counterpart connector 7 (the direction of the arrow B in FIG. 1(*d*)). The right connector 20 thus moves through the action of the pull tab 25 in the direction of the arrow B, and hence is removed.

By providing the pull tabs 15 and 25 on the left connector 10 and the right connector 20 respectively in this way, the operations of removing the left connector 10 and the right connector 20 can thus be carried out easily even if the left connector 10 and the right connector 20 are placed in narrow spaces, and moreover an incorrect operation of mistakenly pulling the cable 3 can be prevented.

It should be noted that, although in the embodiment described above an example was given in which protective covers 13 and 23 made of a conductive material are attached to the outside of the terminal holding members 11 and 21 (which are made of an insulating material) respectively and the pull tabs 15 and 25 are bonded onto the protective covers 13 and 23 respectively, there is no such limitation; rather, it is also possible to leave out the protective covers 13 and 23 and bond the pull tabs 15 and 25 onto the terminal holding members 11 and 21 respectively. In this case, referring to FIG. 2(*b*), the side plate parts 11*b* of the left connector 10 are given a shape so as to surround the flat plate part 11*a*, and the pull tab 15 is bonded to lower faces of the side plate parts 11*b*. Moreover, referring to FIG. 2(*a*), the protective cover 23 of the right connector 20 is eliminated, thus exposing the side plate part 21*b*, and the pull tab 25 is bonded onto a tip end part of the exposed side plate part 21*b*. By bonding the pull tabs 15 and 25 onto the terminal holding members 11 and 21 respectively in this way, as in the case described above in which the pull tabs 15 and 25 were bonded onto the protective covers 13 and 23 respectively, the operations of removing the left connector 10 and the right connector 20 can be carried out easily, and moreover an incorrect operation of mistakenly pulling the cable 3 can be prevented.

Moreover, although in the above-mentioned embodiment the pull tabs 15 and 25 were made of an insulating material, there is no such limitation; rather, the pull tabs 15 and 25 can also be made of a conductive material. If pull tabs 15 and 25 made of a conductive material are bonded onto the protective covers 13 and 23 respectively, then interception of external magnetic fields becomes more effective; if pull tabs 15 and 25 made of a conductive material are bonded onto the terminal holding members 11 and 21 respectively, then the pull tabs 15 and 25 again intercept external magnetic fields, suppressing the effects of noise or the like generated in the electrical wires D.

Figure 4:
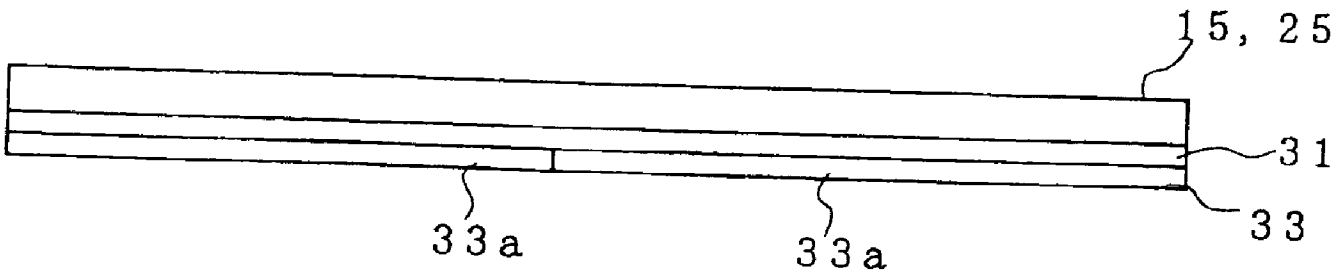
FIG. 4 shows a front view of the above-mentioned pull tab.

An example was given in which the pull tabs 15 and 25 are bonded onto the protective covers 13 and 23 respectively using an adhesive, but there is no such limitation. Rather, as shown in FIG. 4, it is also possible to prepare a pull tab 15 or 25 in which adhesive glue 31 is applied over the whole of the lower face of the pull tab 15 or 25 and then a peelable protective film 33 that protects the adhesive glue 31 and can be peeled away from the lower face of the adhesive glue 31 is stuck onto the adhesive glue 31. When the pull tab 15 or 25 having this adhesive glue 31 is to be bonded onto the protective cover 13 or 23, the peelable protective film 33 is peeled off to expose the adhesive glue 31 and then the pull tab 15 or 25 is bonded onto the protective cover 13 or 23 through the adhesive glue 31. The peelable protective film 33 is divided into two sections 33*a* so as to be easily peelable, with each section 33*a* being stuck onto the adhesive glue 31. Because the peelable protective film 33 is composed of two sections 33*a*, when the peelable protective film 33 is to be peeled off, one can bend the pull tab 15 or 25 so that inside end parts of the sections 33*a* peel away at the place where the sections 33*a* meet and these end parts project outwards, and then grasp the sections 33*a* and pull. If such a pull tab 15 or 25 is used, then the pull tab 15 or 25 can either be bonded on during the connector manufacturing process or can be subsequently bonded onto an existing connector.

Figure 3:
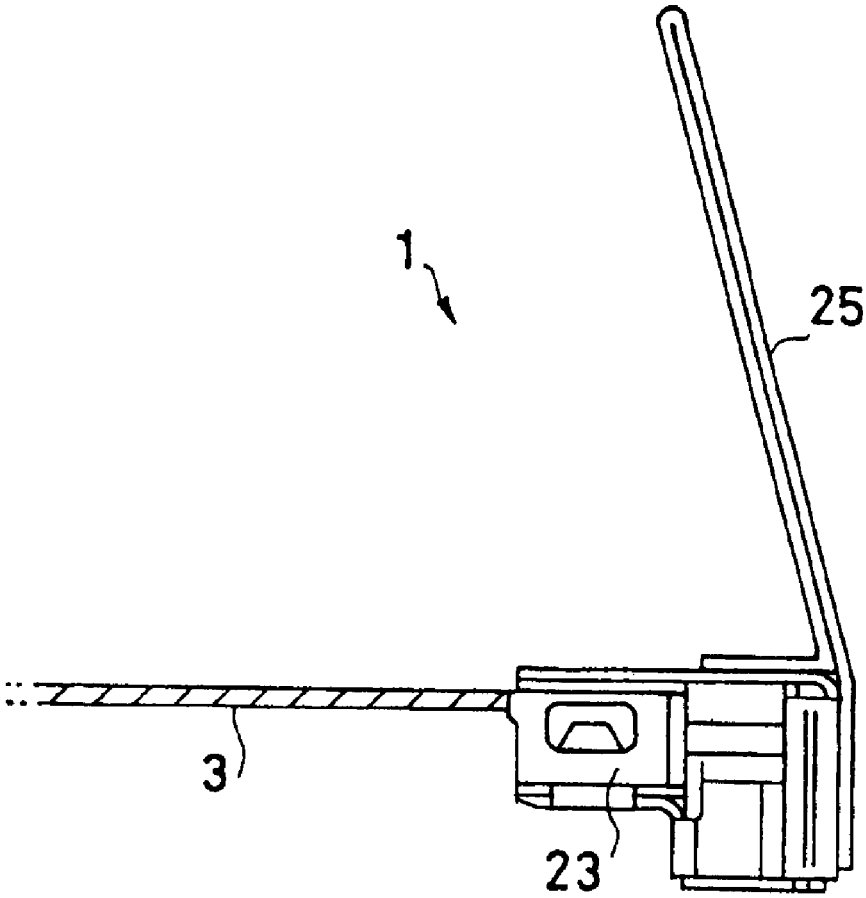
FIG. 3 is a view showing a method of connecting a pull tab of a connector according to an embodiment of the present invention.

Moreover, it is also possible to bond a tip end part of the pull tab 25 onto a tip end part of the protective cover 23 and bond a rear end part of the pull tab 25 onto an upper face of the protective cover 23, and moreover bond inside faces of the tip end part and the rear end part of the pull tab 25 together, as shown in FIG. 3. By using this bonding method and bonding the pull tab 25 onto two adjacent faces of the protective cover 23, the pull tab 25 can be bonded onto the protective cover 23 more strongly.

As described above, according to the connector of the present invention, a pull tab may be bonded onto a terminal holding member, thus allowing the connector to be easily removed from a counterpart connector into which the connector has been fitted by grasping and pulling the pull tab, and ensuring that a cable connected to the connector is not mistakenly pulled instead of the pull tab during the connector removing operation, thus preventing wire breakage.

Moreover, the pull tab may be bonded onto a protective cover, again allowing the connector to be easily removed from a counterpart connector into which the connector has been fitted by pulling the pull tab, and ensuring that the cable connected to the connector is not mistakenly pulled instead of the pull tab during the connector removing operation, thus preventing wire breakage.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

RELATED APPLICATIONS

This application claims the priority of Japanese Patent Application No. 2000-277004 filed on Sep. 12, 2000, which is incorporated herein by reference.

What is claimed is:

1. A connector, comprising terminals, a terminal holding member that is made of an insulating material and holds said terminals, and a cable that is electrically connected to said terminals and extends out from said terminal holding member, and further having a pull tab made from a flexible sheet that has a tip end part thereof bonded onto said terminal holding member and extends outwards, wherein said connector is removed from a counterpart connector into which into which said connector has been fitted by pulling said pull tab, and wherein said connector is a straight type connector, and said tip end part of said pull tab is bonded using an adhesive onto an outside face of said terminal holding member, and a rear end part of said pull tab extends rearward along said outside face.

2. The connector according to claim 1, wherein said pull tab is formed from a conductive material so as to provide a magnetic shield.

3. A connector, comprising terminals, a terminal holding member that is made of an insulating material and holds said terminals, and a cable that is electrically connected to said terminals and extends out from said terminal holding member, and further having a pull tab made from a flexible sheet that has a tip end part thereof bonded onto said terminal holding member and extends outwards, wherein said connector is removed from a counterpart connector into which into which said connector has been fitted by pulling said pull tab, wherein said connector is a right-angled type connector, and said tip end part of said pull tab is bonded using an adhesive onto an outside face on a fitting port side of said terminal holding member, and a rear end part of said pull tab extends rearwardly along said outside face in a direction perpendicular to the direction of said cable.

4. A connector comprising terminals, a terminal holding member that is made of an insulating material and holds said terminals, a cable that is electrically connected to said terminals and extends out from said terminal holding member, and a protective cover that is made of a conductive material and covers said terminal holding member, and further having a pull tab made from a flexible sheet that has a tip end part thereof bonded onto said protective cover and extends outwards, wherein said connector is removed from a counterpart connector into which said connector has been fitted by pulling said pull tab wherein said connector is a straight type connector, and said tip end part of said pull tab is bonded using an adhesive onto an outside face of said protective cover, and a rear end part of said pull tab extends rearward along said outside face.

5. The connector according to claim 4, wherein said pull tab is formed from an insulating housing material such as nylon, PET or a polyester.

6. A connector comprising terminals, a terminal holding member that is made of an insulating material and holds said terminals, a cable that is electrically connected to said terminals and extends out from said terminal holding member, and a protective cover that is made of a conductive material and covers said terminal holding member, and further having pull tab made from a flexible sheet that has a tip end part thereof bonded onto said protective cover and extends outwards, wherein said connector is removed from a counterpart connector into which said connector has been fitted by pulling said pull tab, wherein said connector is a right-angled type connector, and said tip end part of said pull tab is bonded using an adhesive onto an outside face on a fitting port side of said protective cover, and a rear end part of said pull tab extends rearward along said outside face in a direction perpendicular to the direction of extension of said cable.

7. A matable electrical connector comprising a housing having a front, mating face and insulating sidewalls extending rearwardly away from the front, mating face and enclosing a plurality of terminals which extend to the mating face and terminate respective very thin wires of a cable which extends rearwardly from the housing and a flexible conductive sheet having a front edge portion bonded by adhesive to an exterior of one of the side walls adjacent the front, mating face and extends rearwardly in covering and magnetically shielding relation along the sidewall and has a rearwardly extending portion extending clear of a housing rear to form a manually graspable pull-tab by which the connector can be uncoupled from a counterpart connector mated therewith at the mating face.

8. A matable electrical connector according to claim 7 wherein the housing has another insulating sidewall extending transverse to the one sidewall and a rear edge portion of the flexible conductive sheet is bonded by adhesive to said another insulating sidewall and the rearwardly extending portion of the flexible conductive sheet which is between the front edge and the rear edge is folded back on itself into double thickness.

9. The connector according to claim 4, wherein said pull tab is formed from a conductive material so as to provide a magnetic shield therefor.

10. The connector according to claim 2, wherein said connector is a straight type connector, and said tip end part of said pull tab is bonded using an adhesive onto an outside face of said terminal holding member, and a rear end part of said pull tab extends rearward along said outside face.

* * * * *